US005092812A

United States Patent [19]

Babcock

[11] Patent Number: 5,092,812

[45] Date of Patent: Mar. 3, 1992

[54] NURSING SEQUENCE INDICATOR BRA

[76] Inventor: Clarence O. Babcock, #5 S. Flower St., Lakewood, Colo. 80226

[21] Appl. No.: 675,419

[22] Filed: Mar. 26, 1991

[51] Int. Cl.[5] ..... A41C 3/04

[52] U.S. Cl. ..... 450/36; 450/1; 2/104

[58] Field of Search ..... 2/73, 104; 450/36, 37, 450/38, 57, 58, 79

[56] References Cited

U.S. PATENT DOCUMENTS

| | | | |
|---|---|---|---|
| 1,136,727 | 4/1915 | Smith | 450/36 |
| 1,966,174 | 7/1934 | Jones | 450/58 |
| 2,390,465 | 12/1945 | Russo | 450/58 |
| 4,423,734 | 1/1984 | Schawel | 450/37 |
| 4,640,287 | 2/1987 | Anderson et al. | 450/36 |
| 4,878,879 | 11/1989 | Kunstadter | 450/36 |
| 5,024,628 | 6/1991 | Sanchez | 450/36 |

FOREIGN PATENT DOCUMENTS

| | | | |
|---|---|---|---|
| 0901909 | 8/1945 | France | 450/36 |
| 0954092 | 12/1949 | France | 450/36 |
| 1010621 | 6/1952 | France | 450/36 |
| 1063762 | 5/1954 | France | 450/36 |

*Primary Examiner*—Werner H. Schroeder
*Assistant Examiner*—Jeanette E. Chapman
*Attorney, Agent, or Firm*—Clarence O. Babcock

[57] ABSTRACT

An automatic nursing sequence indicator bra that indicates to a nursing mother alternating between two breasts for feeding an infant which breast is to be used next in turn. In the preferred embodiment the nursing sequence indicators are integral parts of the bra cups themselves in the form of two flaps, each a part of the two bra cups. The flaps are inwardly disposed between the two cups with one at least partially covering the other when both bra cups are closed. The flap of the cup opened last for nursing lies so that it at least partially covers the flap of the other cup. The top flap therefore points to the next breast to be used in turn. In a second embodiment, the flaps are added as separate parts to the bra cups. In the preferred and second embodiments the flaps may be stiffened with additional material for flap alignment. The shape of the flaps, and decorations or slogans may aid their intended function.

10 Claims, 2 Drawing Sheets

PRIOR ART A

PRIOR ART B

PRIOR ART C

PRIOR ART C (CONT.)

PREFERRED EMBODIMENT

NURSING SEQUENCE INDICATOR BRA

BACKGROUND OF THE INVENTION

1. Field of the Invention

The field of the invention is that of nursing bras with automatic nursing indicator means wherein the opening and closing of the bra cups indicates to a nursing mother which breast is to be used next in turn. No additional effort in the form of remembering to move and then manually and separately moving the indicator means is required.

2. Description of the Related Art

Nursing mothers usually alternate between the two breasts when feeding an infant, using first one breast and then the other for a number of reasons. First, it relieves a feeling of fullness if not pain. Second, it stimulates the production of milk in both breasts insuring an adequate supply. Third, it helps prevent caking of the milk in the unused breast that could pose health problems.

Traditionally, a safety pin which is manually moved from one side of the bra to the other has been used as a nursing sequence indicator. By manually moving the safety pin from the side of the bra for the breast used last to the side of the bra with the breast to be used next the nursing mother can keep track of the breast to be used next in turn. This manual procedure requires additional effort beyond that of opening and closing the bra cups for nursing. The nursing mother must remember to move the safety pin after each feeding so that the next breast to be used in turn is indicated. Unfortunately, feeding occurs at all hours of the day and night when the mother is sometimes half awake or is otherwise preoccupied and she forgets to move the safety pin nursing sequence indicator. The result is that one breast is used repeatedly and the other breast is not used. In addition, the mother is holding the baby with one hand while trying to move the safety pin nursing sequence indicator with the other hand.

Some improvement was achieved by P. G. Schawel for which she obtained U.S. Pat. No. 4,423,734, Jan. 3, 1984 for a nursing bra with nursing indicator. Her invention uses a permanently attached base member to which is attached a moveable nursing indicator. Her patent describes several embodiments of her invention all of which must be separately and manually moved in the same manner as the safety pin in addition to opening and closing the bra cups. Her indicators are locked into position by one of several means. Essentially, what her improvement does is to insure that the indicator is not lost and the mother and baby are not injured by the safety pin. The loss of the safety pin certainly has been prevented in the past by some mothers by tying the pin to the bra with a string.

OBJECTIVE AND THE ADVANTAGES OF THE INVENTION

The object of the invention is to provide a nursing mother with a nursing bra that automatically indicates to her the status of her nursing with regard to which breast is to be used next or was used last. The advantage of the invention is to provide this automatic indication without additional effort beyond that of opening and closing the bra cups for nursing. Prior art nursing indicator means required that the mother remember to move the nursing sequence indicator after each nursing session, both day and night, and to physically and separately move the indicator after each nursing session, if the indicator is to work as needed. It is apparent that such indicators do not work well for some mothers and poorly or not at all for others. The present invention provides a nursing indicator bra that requires no conscious effort on the part of the mother to maintain the indicator function so that first one breast and then the other is indicated for nursing.

SUMMARY OF THE INVENTION

The invention is for an automatic nursing sequence indicator nursing bra which requires no additional effort beyond the normal opening and closing of the bra cups for nursing to indicate to the nursing mother which breast is to be used next or which breast was used last. In the preferred embodiment two indicating flaps are used, one that is an integral part of the right bra cup and a second that is an integral part of the left bra cup. In this embodiment no additional parts are added to the conventional non indicating nursing bra cups. Only the shape of the cups is changed. The two flaps are located between the two cups so that one flap falls on top of and at least partially covers the other flap when both the cups are closed. The flap of the cup opened and closed last for nursing is on top when both cups are closed between nursing sessions. This top flap points to the other breast which is to be used next for nursing. By top is meant the flap is furthest from the mothers body. In a second embodiment the two flaps are attached, one each, to the two bra cups so one flap at least partly covers and overlaps the other flap when both cups are closed between nursing sessions. In this second embodiment the flaps are separate pieces that are sewed, glued, bonded, or otherwise attached with snaps, velcro or with other fasteners with similar function to the bra cups. This embodiment has the attractive advantage of being addable to nursing bras of standard design or those already in existence manufactured by state of the art techniques. In both the first and second embodiments the mother can determine by vision or by feel which breast is to be used next by determining which flap is on top. This flap points to the other breast which is to be used next. This is emphasized if the flaps are of pointed or arrowhead shape. In both embodiments the nursing mother need not remember to move the nursing sequence indicator since this is done automatically by the opening and closing of the bra cups during the nursing cycle.

The five steps used in the actual nursing process for the two invention embodiments are no more than those required for use of a nonindicating conventional nursing bra. The prior art safety pin nursing sequence indicator and the several Schawel invention indicator means all require a seven step process for the indicator to work. One of these two extra steps per nursing cycle is the remembering and separate manual moving of the indicator means after the left breast is used and the other is the remembering and separate manual moving of the indicator means after the right breast is used. These two steps are unnecessary with the invention embodiments. In the prior art if the mother fails to separately move the indicator means, one breast will be used more than once in turn and the indicator means does not function as intended. In the invention, the indicator means is always in the correct position with no memory or extra manual effort on the part of the nursing mother.

DETAILED DESCRIPTION OF THE DRAWINGS

Figure 1:
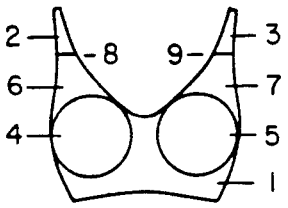
FIGS. 1 through 5 show the five steps, needed for prior art A to complete a nursing cycle for a conventional nonindicating nursing bra without nursing indicator means. This is the minimum number of steps needed to complete the nursing cycle for use of both breasts. There is nothing for the nursing mother to observe to indicate which breast was used last or is to be used next.

FIG. 1 shows the first step in the use of prior art A nursing bra without nursing sequence indicator means at the beginning of the nursing cycle. Both cups 4 and 5 are closed. Cup 4 is supported by strap 6 and cup 5 is supported by strap 7. Strap 6 is attached to shoulder strap 2 with any detachment means 8 known in the prior art. Strap 7 is attached to shoulder strap 3 with any detachment means 9 known in the prior art. Cups 4 and 5 then give both breasts the maximum support between nursing cycles. Right cup 4 and left cup 5 are attached to the front of the bra for at least for a part of their circumference to a band 1 that surrounds the body of the mother. Shoulder strap 2 passes over the right shoulder and is attached behind the mother's back to the band 1 which surround the body of the mother. Shoulder strap 3 passes over the left shoulder and is attached behind the mother's back to the band 1 which surrounds the body of the mother. The prior art attachment means 8 and 9 can be detached so that either cup 4 or cup 5, respectively, can be lowered for nursing. The numbered items in the remainder of the figures have the same meaning as in FIG. 1.

Figure 2:
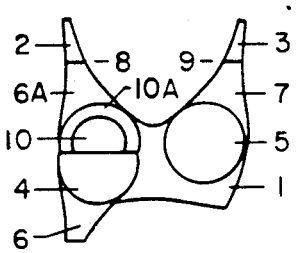

FIG. 2 shows the second step in the nursing process with the prior art A conventional nonindicating nursing bra. The right cup 4 is opened and lowered for nursing by strap 6 after the attachment means 8 has been detached revealing support strap 6A attached to shoulder strap 2 to support a partial cup 10A with an opening for nursing 10. The partial cup 10A provides some support to the right breast during nursing.

Figure 3:
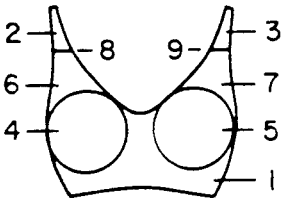

FIG. 3 shows the third step for prior art A for the conventional nonindicating nursing bra in which both cups 4 and 5 are closed to fully support the breasts between nursing sessions. Strap 6 for the right breast supports the right breast cup 4 when attached by means 8 to the right shoulder strap 2. Strap 7 supports the left breast cup 5 when attached by means 9 to left shoulder strap 3.

Figure 4:
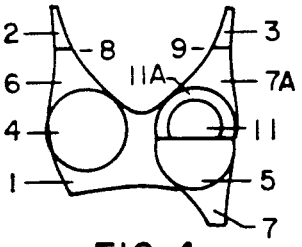

FIG. 4 shows the fourth step for prior art A for the conventional nonindicating nursing bra in which the left cup 5 is opened and lowered by strap 7 for nursing after the attachment means 9 has been detached revealing stationary support strap 7A attached to shoulder strap 3 which supports a partial cup 11A with an opening for nursing 11. The partial cup 11A provides some support to the left breast during nursing.

Figure 5:
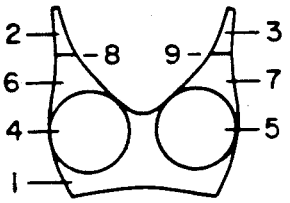

FIG. 5 shows the fifth step for prior art A for the conventional nonindicating nursing bra in which both cups 4 and 5 are closed. Cup 4 is closed and supported by strap 6 when attached with means 8 to shoulder strap 2. Cup 5 is closed and supported by strap 7 when attached by means 9 to shoulder strap 3. Both breasts are fully supported between nursing sessions. These five steps complete the nursing cycle for a conventional non-nursing-sequence nursing bra for prior art A. At no time was there an indication from the bra to the mother which breast was used or was to be used next.

Figure 6:
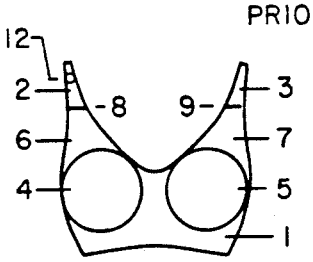
FIGS. 6 through 12 show the seven steps for prior art B, two additional steps more than needed for prior art A, to complete one nursing cycle when a safety pin 12 is used as a nursing sequence indicator which must be separately and manually moved after each nursing session for the nursing sequence indicator to serve its intended purpose.

FIG. 6 shows the first step in the nursing cycle for prior art B with right bra cup 4 closed and supported by strap 6 when attached by detachable means 8 to shoulder strap 2. Left bra cup 5 is closed and supported by strap 7 when attached by detachable means 9 to shoulder strap 3. Full breast support is provided when both cups 4 and 5 are closed. A common safety pin 12 old in the prior art is attached to the right shoulder strap 2 of the bra to indicate that this breast is to be used next for nursing. The safety pin could be attached to any part of the bra but it is convenient to use the right shoulder strap 2. In all other respects the bra of prior art B is identical to the bra of prior art A. Only the safety pin 12 has been added as a nursing sequence indicator which must be moved manually and separately from the opening and closing of the bra cups during nursing. The band 1 surrounds the body of the mother as in prior art A. The cups 4 and 5 are attached to the band 1 in front of the mother's body for a part of the circumference of the bra cups.

Figure 7:
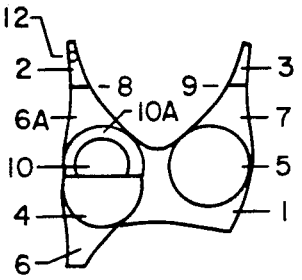

FIG. 7 shows the second step in the nursing cycle of prior art B with the right cup 4 open and lowered with strap 6 after the attachment means 8 has been detached for nursing revealing support strap 6A attached to shoulder strap 2 which supports a partial cup 10A with an opening for nursing 10. The partial cup 10A supplies some support to the right breast during nursing by means of shoulder strap 6A. The safety pin nursing sequence indicator 12 remains attached to the right strap 2. The shoulder straps 2 and 3 pass over the mothers shoulders and are attached to the bra body 1 behind the mothers back usually by sewing but other means could be used.

Figure 8:
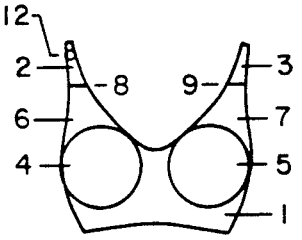

FIG. 8 is the third step in the nursing cycle for prior art B with cup 4 closed and the strap 6 attached by attachment means 8 to shoulder strap 2 and the cup 5 closed and the strap 7 attached by attachment means 9 to shoulder strap 3. The mother receives maximum support between nursing cycles. The safety pin nursing indicator 12 is still attached to the strap 2, the breast side for which nursing was last completed. The nursing operation by itself did not move the safety pin nursing indicator 12.

Figure 9:
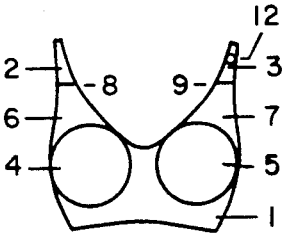

FIG. 9 is the fourth step in the nursing cycle when both bra cups 4 and 5 are closed between nursing sessions for prior art B in which the mother must remember with mental effort and to transfer with physical effort the nursing sequence indicator safety pin 12 from the right bra strap 2 to the left bra strap 3 to indicate that the left breast is to be used next for nursing. These two efforts are in addition to the opening and closing of the bra cups 4 and 5 for nursing. Failure to move the indicator 12 at this time because of lack or sleep of the mother or because of other preoccupation negates the usefulness of the safety pin 12 as a nursing sequence indicator. Again, the safety pin 12 could be attached to any part of the bra in a consistent manner that would indicate to the nursing mother the breast to be used next. Of course the safety pin nursing sequence indicator could be moved at any time prior to, during, or after the nursing cycle with any consistent convention adopted by the mother.

Figure 10:
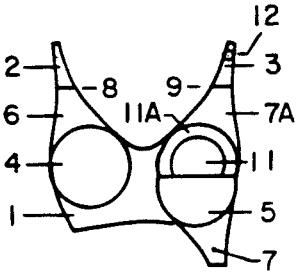

FIG. 10 is the fifth step in the nursing cycle for prior art B in which the left breast strap 7 is detached from the shoulder strap 3 by detachment means 9 and the cup 5 is opened and lowered for nursing from the left breast through the opening 11 in the partial cup 11A. The partial cup 11A is supported during the nursing cycle by strap 7A. The nursing indicator safety pin 12 remains on the side of the breast in use, the left side.

Figure 11:
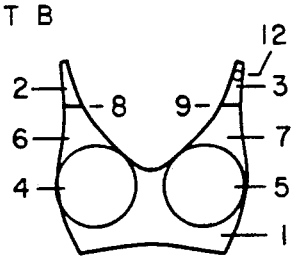

FIG. 11 is the sixth step in the nursing cycle for prior art B in which both breasts are covered again for additional support. Bra cup 4 is closed and the strap 6 is attached by attachment means 8 to shoulder strap 2 and the cup 5 is closed and the strap 7 is attached by attachment means 9 to shoulder strap 3. The safety pin 12 nursing indicator means is still attached to the left bra strap 3, the side of the last breast used for nursing. The opening and closing of the bra cup 5 did not change the position of the nursing sequence indicator 12.

Figure 12:
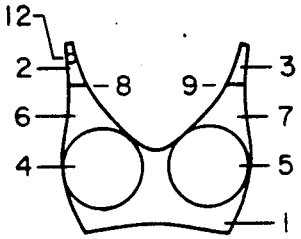

FIG. 12 is the seventh and final step in the nursing cycle for prior art B in which the mother must remember to transfer with mental effort and to transfer with physical effort, the safety pin 12 from the left bra strap 3 to the right bra strap 2 to indicate that the right breast is to be used next in turn for nursing. These two efforts are in addition to the opening and closing of the bra cups for nursing. Failure to move the safety pin nursing indicator 12 at this time because of lack or sleep of the mother or because of preoccupation with other things negates the usefulness of the safety pin as a nursing sequence indicator. Of course, the safety pin could be attached and moved to any part of the bra in a consistent manner chosen by the nursing mother to designate the breast to be used next.

Figure 13:
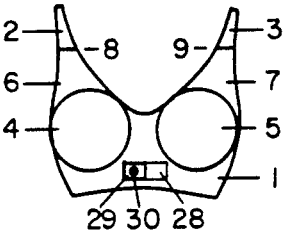
FIGS. 13 through 19 show the seven steps for prior art C, two additional steps more than prior art A, needed to complete one nursing cycle when the preferred embodiment of the Schawel invention of U.S. Pat. No. 4,423,734 is used. This number of operations and the attendant difficulty of remembering to move and then moving the nursing sequence indicator separately from the nursing operation after each nursing session are the same as for the safety pin indicator of prior art B. If the nursing mother forgets to move the indicator it does not serve its intended purpose. All the embodiments of the Schawel patent have this same limitation.

FIG. 13 shows the first step, for prior art C of the nursing cycle when the preferred embodiment of the Schawel invention of U.S. Pat. No. 4,423,734 is used. She discloses a number of nursing indicator means, all manual and similar to the safety pin 12 of prior art B except that the indicator means is permanently attached to the bra, much as would be the case if the safety pin were tied to the bra to prevent it from becoming lost. In addition, her indicator means are less likely to injure the mother and can be moved with one hand. For the first step both bra cups 4 and 5 are closed. The right bra cup 4 is supported by strap 6 attached to shoulder strap 2 by detachment means 8. The left bra cup 5 is supported by strap 7 attached to shoulder strap 3 by attachment means 9. In her preferred embodiment a manual nursing sequence indicator has a base element 28, and a movable sliding element 29 with decorative element 30. The indicator element 29 is slidably movable in a frame 28 permanently attached to the band 1 that surrounds the body of the nursing mother. The slidably moveable marker 29 is manually moved by the mother from one side to the other to indicate which breast is to be used next. The slidable member 29 is held in place by a locking means between the frame 28 and the marker 29 not shown in the figure. Other embodiments not shown but described in U.S. Pat. No. 4,423,734. All of the embodiments of this patent require additional mental and physical effort beyond that of opening and closing of the bra cups for nursing, to make the nursing sequence indicator work as intended as was required by the safety pin nursing sequence indicator of prior art B. All embodiments have some means to keep the indicator in place, once positioned.

Figure 14:
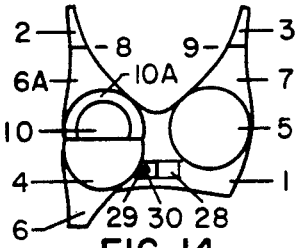

FIG. 14 is the second step in the nursing cycle of prior art C in which the right bra cup strap 6 is detached from attachment means 8 on shoulder strap 2 so that the bra cup 4 can be lowered to expose the opening 10 in the partial cup 10A for nursing. The strap 6A which lies beneath strap 6 when the cup 4 is closed and attached at 8 supports the partial cup 10A and the breast during nursing. Opening of the bra cup 4 does nothing to change the position of the nursing sequence indicator 29 which remains besides bra cup 4.

Figure 15:
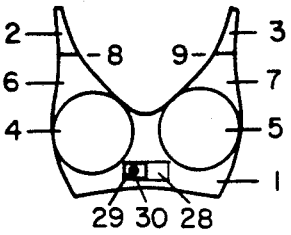

FIG. 15 is the third step in the nursing cycle of prior art C in which both right bra cup 4 and the left bra cup 5 are closed when strap 6 is attached to the shoulder strap 2 by attachment means 8 and strap 7 is attached to the shoulder strap 3 by attachment means 9. Both breasts receive additional support between nursing sessions. The indicator means 29 remains on the side of the breast last used, the right breast covered by bra cup 4 because it was not moved by the opening and closing of the bra cups for nursing. This is true for all of the embodiments of the Schawel patent. All her nursing sequence indicators must be moved with effort in additional to the opening and closing of the bra cups 4 and 5.

Figure 16:
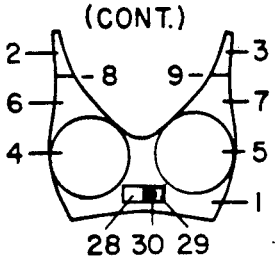

FIG. 16 is the fourth step in the nursing cycle of prior art C showing the nursing indicator 29 after being moved, in separate effort from the nursing procedure, to the side of the left bra cup 5 as is the case in the safety pin nursing sequence indicator of prior art B. If this operation is omitted by the nursing mother because of a semisleep state or is forgotten because of preoccupation the indicator means 29 fails in its intended function, to keep the mother alternating the use of her two breasts for feeding.

Figure 17:
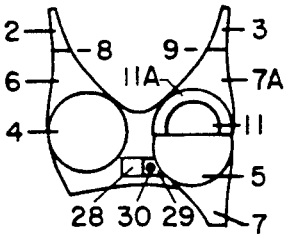

FIG. 17 is the fifth step in the nursing cycle of prior art C showing the left strap 7 detached from attachment means 9 on shoulder strap 3 and the left bra cup 5 lowered to expose the partial cup 11A with opening 11 for nursing. Strap 7A is attached to the shoulder strap 3 to supply support to the nursing breast by means of the partial cup 11A. The mother selected the left breast for nursing because of the position of the nursing sequence indicator 29. If it had not been moved as in FIG. 16 by separate effort on the part of the mother the right breast would be used twice in a row without the alternation between breasts desired.

Figure 18:
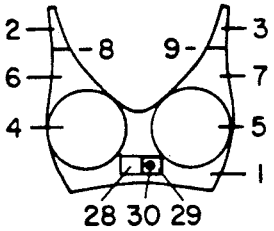

FIG. 18 is the sixth step of prior art C showing bra cup 4 closed and supported by strap 6 when it is attached by means 8 to shoulder strap 2. Cup 5 is closed and supported by strap 7 when it is attached by means 9 to shoulder strap 3. The nursing indicator means 29 remains on the side of the bra just used, the side of the left bra cup 5. Opening and closing the bra cups during the nursing cycle did not change the location of the nursing sequence indicator. This is true for all the embodiments of the Schawel patent. Both breasts are again supported between nursing sessions.

Figure 19:
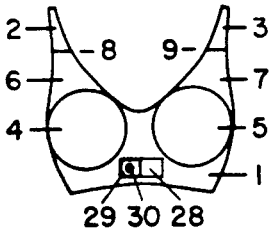

FIG. 19 is the seventh and last step of prior art C showing the FIG. 18 configuration after the nursing indicator means 29 has been manually moved by separate effort after the nursing session from the left bra cup 5 to the side of the right bra cup 4. If this operation is omitted because of a semisleep state of the mother or is otherwise forgotten because of preoccupation, the indicator means 29 fails in its intended function, to keep the mother alternating the use of her two breasts for feeding.

Figure 20:
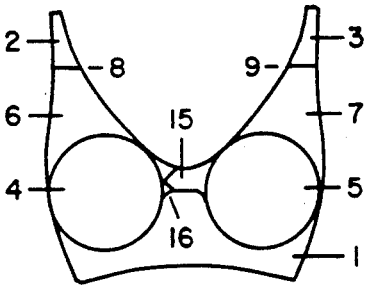
FIGS. 20 through 24 show the five steps needed for the preferred and second embodiments of the invention to complete one nursing cycle. The nursing mother need not remember to move the nursing sequence indicators in the form of two flaps 15 and 16, because this is done automatically with the opening and closing of the bra cups 4 and 5. The invention requires no additional steps beyond the five necessary for a conventional nursing bra without nursing sequence indicator of prior art A. The invention requires two less steps than prior art B and C.

FIG. 20 shows the first step in the use of the first and second embodiments of the invention. Cup 4 is closed and supported by strap 6 which is attached by attachment means 8 to shoulder strap and 2. Cup 5 is closed and supported by strap 7 which is attached by attachment means 9 to shoulder strap 3. Both breasts are supported between nursing sessions. An indicator means in the form of a flap 15 points to the right breast to indicate that this breast is to be used next in the nursing cycle. This position was automatically determined because the left bra cup 5 was opened and closed last. That is, indicator means 15 falls on top of and at least partly covers indicator means 16 because cup 5 was opened and closed last. The flaps 15 and 16 may be in the shape of an arrowhead to point to the next breast to be used.

Figure 21:
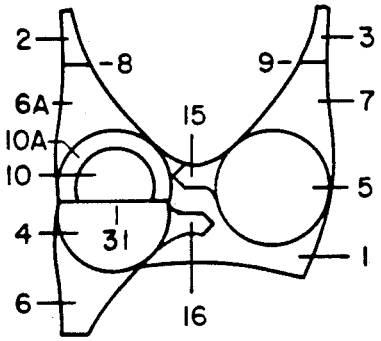

FIG. 21 shows the second step in the use of the first and second embodiments of the invention with the right cup 4 opened and lowered for nursing after detaching the strap 6 from the attachment means 8 of shoulder strap 2. Lowering the right cup 4 pulls the indicator means 16 from under indicator means 15. The bra cup 4 folds along line 31 to allow the flap 16 to be pulled from under the flap 15 when the bra cup 4 is opened for nursing. Opening bra cup 4 exposes the partial cup 10A with opening 10 for nursing. The partial cup 10A is supported by strap 6A which is attached to shoulder strap 2. The flap 15 points to the side of the right breast and the flap 16 points to the side of the left breast.

Figure 22:
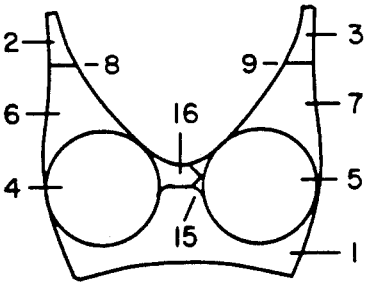

FIG. 22 shows the third step in the use of the first and second embodiments of the invention when both cups 4 and 5 are closed. The cup 4 is supported by strap 6 which is attached by means 8 to the right shoulder strap 2 for increased breast support between nursing sessions. The closing of the bra cup 4 causes the indicator means 16 to be on top of and to at least partially cover the indicator means 15 thereby automatically indicating by pointing that the left bra cup 5 is to be used next. The cup 5 is supported by strap 7 which is attached by means 9 to the left should strap 3. There is no need to remember and then move the indicator means 16 because this was accomplished by the opening and closing of the bra cup 4. Both breast received full support between nursing cycles.

Figure 23:
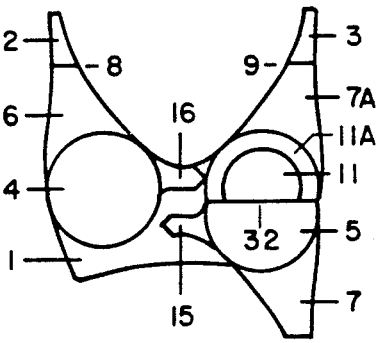

FIG. 23 shows the fourth step in the use of the first and second embodiments of the invention with the strap 7 for the left cup 5 detached from shoulder strap 3 by attachment means 9 and lowered for nursing. This lowering of left bra cup along fold line 32 pulls the indicator flap 15 from under the indicator flap 16. The partial bra cup 11A containing a hole for nursing 11 is attached by strap 7A to shoulder strap 3.

Figure 24:
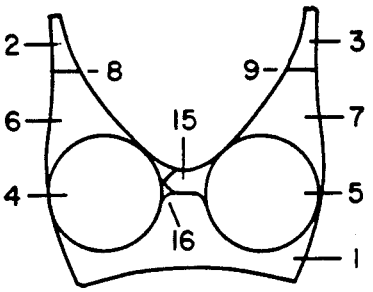

FIG. 24 shows the fifth step in the use of the first and second embodiments of the invention with both cups 4 and 5 closed when their supporting straps 6 and 7 are attached to attachment means 8 and 9, on shoulder straps 2 and 3, respectively, for support of both breasts between nursing sessions. The indicator means 15 is again on top of and at least partially covers indicator means 16. Indicator means 15 again points to the right breast 4 to begin a new nursing cycle. There is no need to remember and then move the indicator means 15 because this was accomplished by the opening and closing of the bra cup 5. The five step nursing process for FIGS. 20 through 24, is of the same complexity for the nursing mother as the prior art A bra but with the important additional feature of automatically indicating which breast is to be used next without conscious effort on the part of the nursing mother as is required for prior art B and prior art C. No additional effort either physical or mental is required by the nursing mother beyond the opening and closing of the bra cups for nursing. In prior art B and C both with manual nursing indicators the nursing mother must remember to move the indicator which is a mental effort, and then to move the indicator which is a physical effort.

Figure 25:
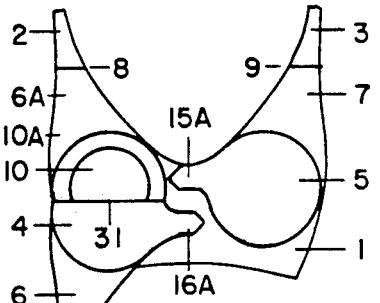
FIG. 25 shows the preferred embodiment of the invention having nursing sequence indicator flap 15A that is an integral part of left bra cup 5 and nursing sequence indicator flap 16A that is an integral part of right bra cup 4. Each flap and cup are a single structural unit which may be constructed of at least one part each. The terms left and right refer to the mother's breasts and not to the drawing as viewed.

FIG. 25 shows the first embodiment of the invention which is the preferred embodiment with nursing sequence indicator flaps 15A and 16A both created as integral parts of the bra cup shape. That is, the bra cups 4 and 5 are themselves nursing sequence indicator means. No additional separate elements need be added. Indicator flap 15A is an integral part of bra cup 5 and indicator flap 16A is an integral part of bra cup 4. While the cup and flap could be made structurally from a single layer or sandwiched layers of material, they could also be constructed of separate pieces in a variety of shapes and sizes to obtain the integral structure needed. One or more layers or pieces could be of a stiffening material to maintain nursing indicator means alignment. That is, to insure that one flap at least partially covers the other flap when both bra cups are closed. Additionally, some decoration and/or slogan may be added to enhance the toy entertainment value of the bra. For example an arrow design or slogan may be added to the indicator elements 15A and 16A. FIG. 25 shows strap 6 detached from attachment 8 and cup 4 opened for use of the right breast but an analogous relationship holds for using the left breast as well as demonstrated in FIGS. 20 through 24.

Figure 26:
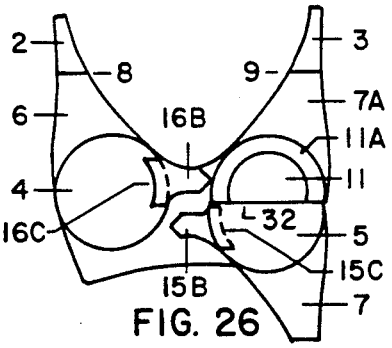
FIG. 26 shows the second embodiment of the invention having nursing indicator means 15B that is a separate flap attached to left bra cup 5 and indicator means 16B that is a separate flap that is attached to right bra cup 4. Attachment is by sewing, bonding with adhesives, attached with snaps or velcro, rivets or with their functional equivalents. Flap 15B is attached at 15C and flap 16B is attached at 16C. This embodiment allows automatic nursing means to be added to an existing conventional nursing bras by the addition of the two flaps one attached to each of the two cups. Each flap consists of at least one piece of material. If attached with snaps, the flaps can be removed, if this is desired at any time.

FIG. 26 shows the second embodiment of the invention in which the nursing sequence indicator means 15B and 16B are separate flaps sewn, glued, bonded, or otherwise fastened to the bra cups, at 15C and 16C, respectively. This configuration allows the addition of indicator means to nursing bras of prior art A design by the addition of two indicator flaps 15B and 16B attached to the bra cups 4 and 5 at 15C and 16C, respectively. The flaps could be added after the time of manufacture including installation by the mother herself. The flaps should be soft enough so as not to irritate the breasts but may be rigid enough to insure that the flap on top at least partially covers the other flap when both flaps are closed between nursing sessions. FIG. 26 shows cup 5 opened for use of the left breast but an analogous relationship holds for using the right breast as well as shown in FIGS. 20 through 24. When the flaps 15B and 16B are attached at 15C and 16C by means of detachable fasteners, such as snaps or velcro, they may be easily removed if and when the need arises. FIG. 26 shows strap 7 detached from attachment means 9 and bra cup 5 opened for use of the left breast but an analogous relationship holds for using the right breast as well as demonstrated in FIGS. 20 through 24.

I claim:

1. An automatic nursing sequence indicator bra that requires no effort by a nursing mother beyond that of opening and closing of either a right or a left bra cup during a nursing cycle to indicate that the unused breast is to be used in turn for nursing, in combination with said nursing bra of conventional design, comprising:

(a) two automatic nursing sequence indicator flaps that are structurally separate from two support straps for said opening and closing of said bra cups said flaps being activated by said opening and closing of said bra cups for nursing, said first flap being at least a part of said right bra cup and said second flap being at least a part of said left bra cup, (b) said automatic nursing sequence indicator flaps being positionally disposed by said opening and closing of said bra cups to (c) automatically indicate to said nursing mother which breast is to be used next in turn for nursing, (d) wherein one of said flaps is on top of and at least partially covers said other flap when said bra cups are both closed between nursing cycles, and (e) said position of said flaps indicates to said nursing mother which breast is to be used next in turn.

2. Said automatic nursing sequence indicator bra of claim 1 wherein said first flap is an integral part of said right bra cup, and said second flap is an integral part of said left bra cup.

3. Said automatic nursing sequence indicator bra of claim 1 wherein said flaps are fastened to said bra cups by sewing, hooking, gluing, riveting, clipping, snapping, or by means of velcro.

4. Said automatic nursing sequence bra of claim 1 wherein the first and second indicator flaps contain at least a layer of stiffer material to maintain flap alignment and that said one flap at least partially covers said other flap when both cups are closed between nursing cycles, said material not contributing significantly to breast support.

5. The automatic nursing sequence bra of claim 1 further comprising a use of a flap shape, a decorative design and a slogan for said nursing indicator flaps to prompt the mother as to the next breast to be used.

6. An automatic nursing sequence indicator bra that requires no effort by a nursing mother beyond that of opening of a first or a second bra cup to indicate that she is to use first one breast and then another in turn for nursing, in combination with a said nursing bra of conventional design, comprising;

(a) a first nursing sequence indicator flap that is at least a part of said first bra cup, and (b) a second nursing sequence indicator flap that is at least a part of said second bra cup, (c) said first and second nursing sequence indicator flaps positionally disposed between said two bra cups when both cups are closed between nursing sessions so that, (d) said two flaps alternate in their position with first one flap at least partly covering said second flap and then said second flap at least partly covering said first flap in turn when said two bra cups are closed, (e) to indicate to said nursing mother by said flap position and appearance which breast is to be used next for nursing, (f) said flaps being intended for nursing sequence indication only and not for breast support.

7. Said automatic nursing sequence indicator bra of claim 6 wherein said flaps are integral parts of said bra cups.

8. Said automatic nursing sequence indicator bra of claim 6 wherein said flaps are fastened to said bra cups by sewing, bonding, gluing, riveting, or snapping.

9. Said automatic nursing sequence bra of claim 6 wherein said two indicator flaps contain at least a layer of stiffer material to insure flap alignment and that said first flap is at least partially covered by said second flap or the second flap is at least partially covered by said first flap in turn when both bra cups are closed between nursing cycles.

10. Said automatic nursing sequence bra of claim 6 further comprising, a use of a flap shape, a decorative design and an instructional word or slogan for the nursing indicator flaps to prompt said mother as to which breast to be used next.

* * * * *